US006811381B2

(12) United States Patent
Dooley

(10) Patent No.: US 6,811,381 B2
(45) Date of Patent: Nov. 2, 2004

(54) STANDING WAVE EXCITATION CAVITY FLUID PUMP METHOD OF OPERATION

(75) Inventor: Kevin Allan Dooley, Mississauga (GB)

(73) Assignee: Pratt & Whitney Canada Corp., Quebec (CA)

( * ) Notice: Subject to any disclaimer, the term of this patent is extended or adjusted under 35 U.S.C. 154(b) by 0 days.

(21) Appl. No.: 10/696,455

(22) Filed: Oct. 29, 2003

(65) Prior Publication Data

US 2004/0086399 A1 May 6, 2004

Related U.S. Application Data

(62) Division of application No. 10/033,767, filed on Dec. 27, 2001, now Pat. No. 6,672,847.

(51) Int. Cl.[7] ..... F04B 45/067
(52) U.S. Cl. ..... 417/53
(58) Field of Search ..... 417/53, 322, 394, 417/412, 383, 413.1

(56) References Cited

U.S. PATENT DOCUMENTS 2,888,877 A * 6/1959 Shellman et al. ..... 417/413.1
3,150,592 A * 9/1964 Stec ..... 417/322
3,173,372 A * 3/1965 Baldwin ..... 417/394
3,743,446 A * 7/1973 Mandroian
5,020,977 A * 6/1991 Lucas
5,267,836 A * 12/1993 Culp
5,588,854 A * 12/1996 Ikumi et al.
5,769,608 A * 6/1998 Seale
6,079,214 A * 6/2000 Bishop
6,234,765 B1 * 5/2001 Deak

FOREIGN PATENT DOCUMENTS

DE 2516165 * 10/1976
DE 19539020 * 4/1997

* cited by examiner

*Primary Examiner*—Michael Koczo
(74) *Attorney, Agent, or Firm*—Bachman & LaPointe, P.C.

(57) ABSTRACT

A pump includes an outer body; and a wall within said outer body. The outer body and the wall define a pumping cavity and an excitation cavity within the outer body. An excitable medium is contained within the excitation cavity. An excitation source is coupled to said excitable medium. This excitation source is operable to excite the excitable medium and create a standing wave therein. The standing wave acts through the wall to pump said fluid through said pumping cavity. Advantageously, the excitable medium is isolated from the pumped fluid by the wall.

2 Claims, 7 Drawing Sheets

STANDING WAVE EXCITATION CAVITY FLUID PUMP METHOD OF OPERATION

CROSS-REFERENCE TO RELATED APPLICATION

The instant application is a divisional application of U.S. patent application Ser. No. 10/033,767 filed Dec. 27, 2001 now U.S. Pat. No. 6,672,847 which is currently pending.

FIELD OF THE INVENTION

The present invention relates to pumps and in particular to standing wave pumps.

BACKGROUND OF THE INVENTION

Pumps are used in many applications to move or compress a pumped fluid (i.e. a liquid or gas). Pumps are typically categorized as dynamic pumps or displacement pumps. Dynamic pumps add energy to a pumped fluid to increase its velocity. Displacement pumps use a volume change to displace pumped fluid in order to compress and pump the fluid. In any event, the majority of conventional pumps use moving parts. Use of moving parts lowers pump efficiency through energy losses against frictional forces. Moving parts also reduce overall pump dependability and increase cost of operation since they are subject to mechanical failure and fatigue and require maintenance. Moving parts also generally require the application of a lubricant, which needs to be replenished and which must be isolated from the pumped fluid.

In order to overcome some of the problems of conventional mechanical moving parts pumps, pumps that have fewer or no moving parts have been proposed. These pumps often pump fluids without using direct mechanical interactions with the fluid to displace or compress the fluid. With fewer moving parts, these pumps are also typically lighter than moving pumps capable of pumping fluids at the same rates and pressures. Such example pumps pressurize fluids using heat, or excite the fluids by various methods. Some pumps achieve a pumping action using the properties of standing waves, and are sometimes referred to as "Standing Wave Pumps".

In general, these standing wave pumps include a chamber defining a pump cavity. The chamber has a fluid inlet and outlet through which the pumped fluid enters and exits. An excitation source provides excitation energy to establish a standing wave in the pumped fluid in the chamber. The excitation source is matched to the pumped fluid and the length of the excitation chamber so that a travelling wave generated by the excitation source is reflected upon itself within the chamber to create the standing wave. The excitation source may be mechanical, electrical, thermal, electromagnetic or the like. The standing wave results in one or more pressure nodes and pressure anti-nodes within the chamber and the pumped fluid. Generally, the pressure at a pressure node is relatively constant at approximately the undisturbed pressure of the pumped fluid while the pressure at a pressure anti-node fluctuates above and below the undisturbed pressure of the pumped fluid. The inlet and outlet may be placed proximate the pressure nodes and anti-nodes of the chamber, respectively. Thus, fluid may be guided from the outlet through a check valve that prevents the pumped fluid from re-entering the chamber during low pressure portions of the cycle at the pressure anti-node.

In conventional standing wave pumps, the excitation source acts directly on the pumped fluid, and is matched to the speed of a travelling wave within the pumped fluid and the length of the excitation chamber. As such, a particular pump may only be suitable for pumping a single type of fluid. Even more disadvantageously, particular excitation sources may not be effective or may only be able to act on a limited class of pumped fluids. For example, electric and magnetic excitation sources may only act on fluids having certain electric and magnetic properties. Moreover, microscopically, the action of the excitation source may be harsh and could have an adverse effect on the pumped fluid.

There is therefore a need for an improved pump that uses the properties of standing waves.

SUMMARY OF THE INVENTION

It is therefore an object of this invention to provide a pump that uses a standing wave within an excitable medium in order to pump fluids.

In accordance with the invention, a standing wave is established within a contained excitable medium. The excitable medium is allowed to exert pressure on a pumping cavity isolated from the excitable medium by a wall. The standing wave acts through the wall to exert pressure on a pumped fluid within the pumping cavity, thereby pumping the fluid through a pumping cavity from an inlet to an outlet.

In accordance with an aspect of the present invention a pump includes an outer body defining a pumping cavity. The outer body includes an inlet and an outlet in communication with the pumping cavity. A housing defines a driving cavity. The housing includes an outer surface at least partially contained within the pumping cavity. An excitable medium is contained in the driving cavity. An excitation source is in communication with the excitable medium to create a standing wave within the excitable medium which causes deformation of the outer surface of the housing. A pumped fluid is pumped from the inlet to the outlet through the pumping cavity by the deformation of the outer surface of the housing when the excitation source is operated.

In accordance with another aspect of the present invention there is provided a pump including a hollow cylindrical housing forming a driving cavity. A hollow cylindrical outer body has a larger diameter than, and is positioned co-axially with the housing forming a pumping cavity therebetween. An excitable medium is provided within the driving cavity. An excitation source creates a standing pressure wave in the excitable medium. The standing wave forms pressure nodes and pressure anti-nodes in the excitable medium. An inlet in the outer body is adjacent to the pressure node of the standing wave. An outlet in the outer body adjacent to the pressure anti-node of the standing wave. A pumped fluid is pumped from the inlet to the outlet through the pumping cavity when the excitation source is operated.

In accordance with yet another aspect of the present invention there is provided a method of pumping a pumped fluid including exciting an excitable medium provided in a housing to produce a standing wave therein and thereby produce deformations in the housing and providing the pumped fluid to a pumping cavity in communication with the housing such that the deformation generates volume changes in the pumping cavity. The pumped fluid is thus pumped through the pumping cavity.

In accordance with yet a further aspect of the present invention there is provided a pump including a housing defining a driving cavity containing an excitable medium. An outer body defines a pumping cavity. The pumping cavity at least partially contains an outer wall of the housing. An inlet and an outlet are in communication with the pumping cavity to guide a pumped fluid to and from the pumping cavity. An excitation source is in communication with the excitable medium, and operable to produce a travelling mechanical wave within the excitable medium. The excitation source, the excitable medium and the driving cavity are matched to produce a standing pressure wave within the excitable medium as a result of the travelling mechanical wave. The outer wall of the housing deforms as a result of the standing pressure wave, and thereby exerts pressure on the pumped fluid within the pumping cavity. The pressure on the pumped fluid forces the pumped fluid from the pumping cavity through the outlet.

In accordance with an aspect of the present invention there is provided a method of pumping a pumped fluid including establishing a standing wave within a secondary fluid; allowing the secondary fluid to exert pressure on a wall in contact with the pumped fluid, to deform the wall; using deformation of the wall to pump the pumped fluid from an inlet to an outlet.

In accordance with an aspect of the present invention there is provided a pump including an outer body and a wall within the outer body. The outer body and the wall define a pumping cavity and an excitation cavity within the outer body. An excitable medium is within the excitation cavity. A pumped fluid is within the pumping cavity. An excitation source is coupled to the excitable medium. The excitation source is operable to excite the excitable medium and create a standing wave therein. The standing wave acts through the wall to pump the fluid through the pumping cavity.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures, which illustrate, by the way of example only, embodiments of this invention.

DETAILED DESCRIPTION

Figure 1:
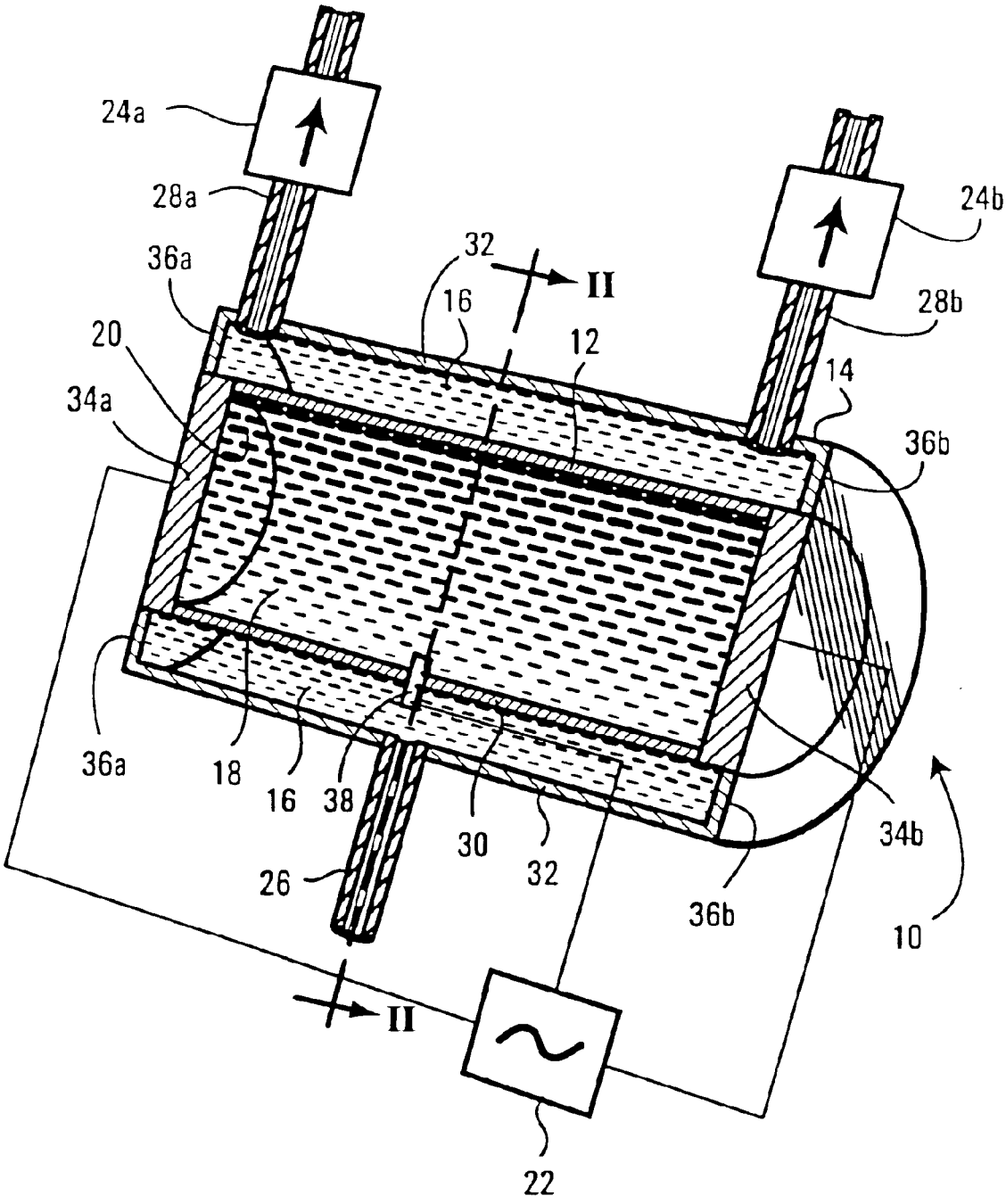
FIG. 1 is a schematic diagram of a pump, exemplary of an embodiment of the invention.
Figure 2:
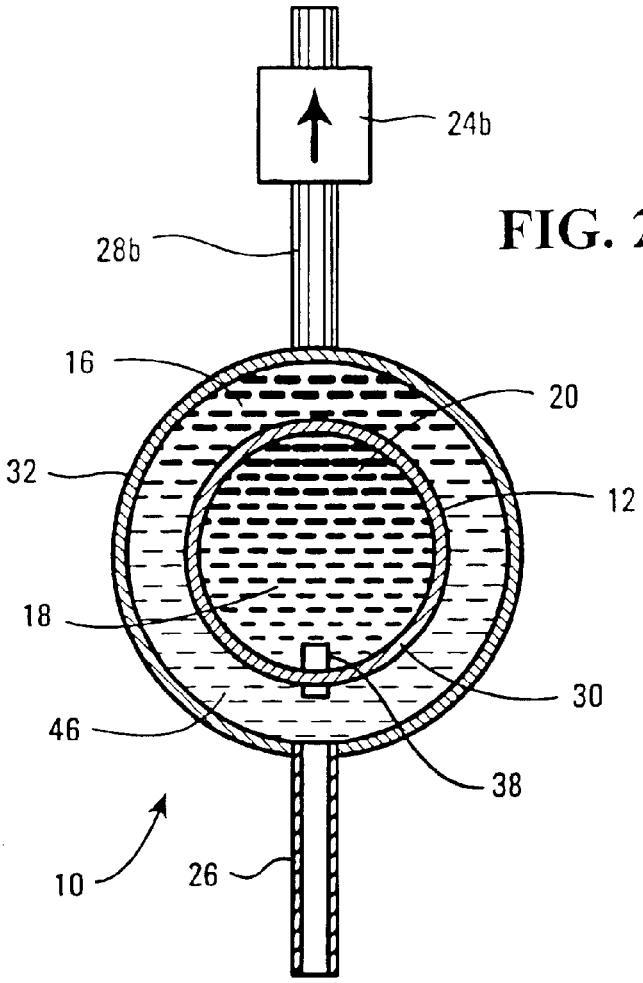
FIG. 2 is a schematic cross-sectional view of the pump of FIG. 1, taken along line II—II.
Figure 3:
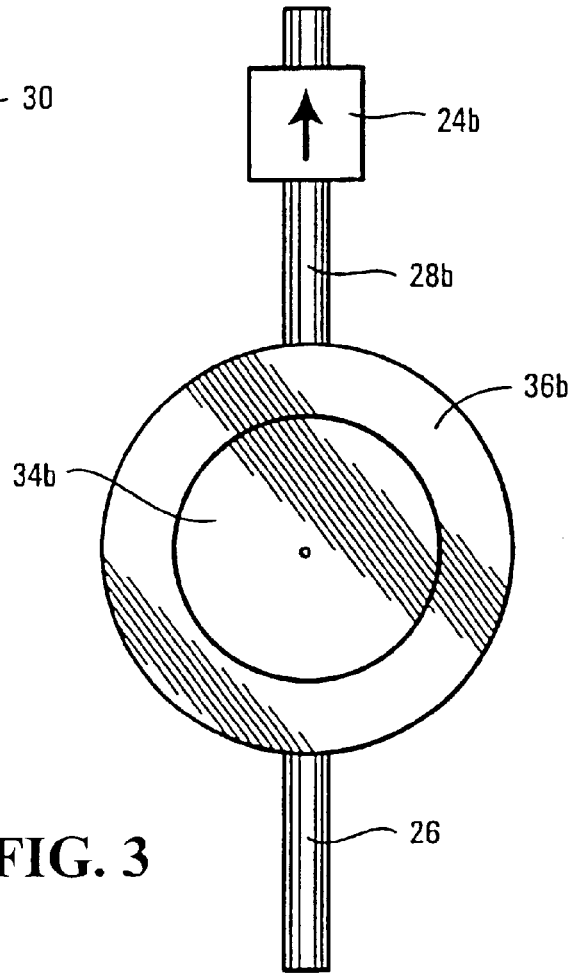
FIG. 3 is an end view of the pump of FIG. 1.

FIGS. 1–3 illustrate a pump 10, exemplary of an embodiment of the present invention. As illustrated, pump 10 includes a housing 12 contained at least partially within an outer body 14. Housing 12 is formed by an outer wall 30 that defines a hollow driving (or excitation) cavity 18. Outer body 14 is formed by an outer wall 32 and is similarly hollow forming a pumping cavity 16 between outer wall 32 of outer body 14 and outer wall 30 of housing 12. Outer body 14 includes an inlet 26 and outlets 28*a* and 28*b* that extend away from body 14 and away from the central axis of pump 10. Inlet 26 and outlets 28*a* and 28*b* are in fluid communication with pumping cavity 16 to allow pumping of a pumped fluid 46. Preferred positions of inlet 26 and outlets 28*a* and 28*b* along the length of pump 10 are described below.

In the illustrated embodiment, housing 12 and outer body 14 are regular cylinders, coaxial with each other, as best viewed in FIG. 2. Housing 12 has a smaller diameter than outer body 14. Preferably, housing 12 and outer body 14 are the same length.

Exemplary one way check valves 24*a* and 24*b* are in communication with the outlets 28*a* and 28*b*, respectively. These valves 24*a* and 24*b*, if required, may limit back flow of a pumped fluid 46 into pumping cavity 16. Valves 24*a*, 24*b* may be Tesla valves, Reed valves, or other suitable valves known to those of ordinary skill.

Housing 12 defines a driving cavity 18. An excitable medium 20 fills driving cavity 18. An excitation source 22 is provided in communication with excitable medium 20 and is coupled to excitable medium 20, so that excitation source 22 may generate corresponding displacement and pressure waves within excitable medium 20. As will become apparent, this arrangement allows excitation source 22 to act on excitable medium 20 to generate a standing pressure wave therein. Preferably, driving cavity 18 is sealed at its ends by transducers 34*a* and 34*b*. Transducers 34*a* and 34*b* form part of excitation source 22 and are used to generate travelling waves that travel along the length of driving cavity 18, between its ends. As should be appreciated, so sealed, driving cavity 18 is closed. That is, in normal operation excitable medium 20 cannot enter or exit from driving cavity 18.

Preferably, excitable medium 20 is matched or coupled to the excitation source 22, ensuring that the excitation source 22 may excite excitable medium 20. Excitable medium 20, may be a secondary fluid different from pumped fluid 46. Excitable medium 20 is preferably a liquid. Examples of suitable excitable media include water, oil, carbon fuels, or any other medium that may be excited as described herein. Excitable medium 20 is also preferably pre-pressurized within driving cavity 18 to a chosen static pressure. In this way the excitable medium 20 may be excited to fluctuate in pressure above and below this static pressure.

Outer wall 32 of the outer body 14 is formed of a relatively rigid material. Outer wall 30 of the housing 12, on the other hand, is preferably formed of a material allowing outer wall 30 to deform as excitable medium 20 is excited within driving cavity 18, and thereby transmit the effects of driving cavity 18 to pumping cavity 16. Outer wall 30 may for example be formed of metal, steel, rubber, plastic or the like, depending on the operating frequency and pressure of excitable medium 20.

As will be appreciated, housing 12 and outer body 14 may be otherwise arranged. For example, housing 12 and outer body 14 need not be cylindrical in shape. Housing 12 and outer body 14 may be toroidal or rectilinear, or of any other suitable shape appreciated by those of ordinary skill. Further, housing 12 and outer body 14 need not be the same shape or length. Similarly, housing 12 and outer body 14 need not be coaxial. A person of ordinary skill will readily appreciate other arrangements of housing 12 and outer body 14 forming an appropriate driving cavity 18 and pumping cavity 16. For example, any suitable wall may be used to divide the interior of housing 12 into driving cavity 18 and pumping cavity 16.

Pumping cavity 16 may be sealed at each of its ends by annular walls 36*a* and 36*b*, extending radially outward from transducers 34*a* and 34*b* to outer wall 32. As illustrated in FIG. 3, annular wall 36*b* and transducer 34*b* when at rest, may be co-planar, thereby defining a disk-shaped end wall for pump 10.

Excitable medium 20 and excitation source 22 are chosen and designed to produce an appropriate standing acoustic wave within driving cavity 18. Excitation source 22 may be formed, for example as shown in FIG. 1, using two transducers 34*a* and 34*b* at either end of driving cavity 18. These transducers 34*a* and 34*b* act as agitators and may be piezoelectric transducers, or other electromechanical transducers known to those of ordinary skill. Alternatively, excitation source 22 may include a single transducer (not shown) located at an intermediate point along the length of housing 12 so as to excite excitable medium 20.

As an alternative, excitation source 22 could include an axially moveable end wall in place of transducers 34, formed as part of a housing 12 having a length shorter than outer body 14.

As a further alternative, excitation source 22 could include an electrical discharge device (not shown) placed within driving cavity 18 adapted to release an electrical spark creating a hydrostatic pressure wave of very high pressure within excitable medium 20. Such a hydrostatic pressure wave results from the sudden extreme and localized heat release and the resulting local evaporation and re-condensation of the excitable medium 20. As yet a further alternative, excitation source 22 may be formed of a plurality of heating elements (not shown) placed lengthwise along driving cavity 18. A control unit (not shown) could sequentially heat such individual heating elements to provide localized heating of excitable medium 20 applied longitudinally in driving cavity 18 and thereby creating pressure differentials to generate a travelling wave within excitable medium 20. Similarly, instead of a localized heat generator, excitable medium 20 could be electrostrictive or magnetostrictive, and a corresponding source of magnetic flux or an electric field could be arranged to generate a lengthwise travelling magnetic or electric wave that acts on excitable medium 20 to create a corresponding acoustic wave. Yet another excitation source could include a localized heat source, such as a laser diode, resistance heater or the like. Oscillations within the excitable medium 20 could be produced by causing a liquid forming excitable medium to rapidly change phase, between liquid and vapor. Direct or alternating current could drive such a heat source. Other alternative excitation sources 22 are described in, for example, U. S. Pat. No. 5,020,977 to Lucas, the contents of which are hereby incorporated by reference, or will be known to one of skill in the art.

Optionally, a pressure sensor 38 is communication with excitation source 22. As detailed below, measurements of pressure sensed at sensor 38 may control the frequency of operation of excitation source 22. Pressure sensor 38 may be a conventional pressure transducer providing an electric signal in proportion to measured pressure.

Further excitation source 22 may include a controller (not specifically illustrated) operable to control the frequency of operation of excitation source 22, and thereby the frequency of excitations within driving cavity 18. This controller may, for example, be a proportional-integral-differential ("PID") controller configured to respond to sensed measurements, as provided by pressure sensor 38.

The length of housing 12 is designed in co-ordination with the excitable medium 20 and the excitation source 22 so that excitation of excitable medium 20 may produce a standing wave 24 within driving cavity 18. Preferably, the length of housing 12 and excitation source 22 are matched so that the length of housing 12 equals a half wavelength ($\lambda/2$) (where $\lambda=c/f$) of a travelling wave in excitable medium 20. The net characteristic acoustic velocity (c) within excitable medium 20 is the speed of sound within excitable medium 20. Of course, the length of the cavity could be chosen to be an odd integer multiple of one half the wavelength (i.e. $n\lambda/2$ where n is an odd integer).

In operation, excitation source 22 generates a travelling acoustic wave having a wavelength $\lambda$ within excitable medium 20 within driving cavity 18. In the embodiment of FIG. 1, a longitudinal travelling wave is generated by the synchronized oscillations of transducers 34*a* and 34*b*. As noted, a similar travelling wave could be formed in excitable medium 20 in any number of known ways. As will be appreciated, the travelling wave may propagate in directions that are not longitudinal. In any event, when this travelling wave is incident on a transducer 34*b* or 34*a* it is reflected and travels distance $\lambda/2$ to arrive in-phase at transducer 34*a* or 34*b*. As described above, the length of housing 12 and frequency of excitation source 22 thus cause driving cavity 18 to act as a resonant cavity. A standing acoustic wave 48 (see FIG. 4) is, in turn, established within excitable medium 20. As will be appreciated, the acoustic wave 48 manifests itself in alternating regions of high and low pressure along the length of driving cavity 18. It is further characterized by nodes and anti-nodes. Pressure at each point along the length of cavity varies cyclically from in time. At the nodes, the pressure remains constant at the undisturbed pressure of the excitable medium. The ongoing reflection of travelling acoustic waves at transducers 34 results in an ongoing reinforcement and resulting resonance.

Notably, the net characteristic velocity (c) within driving cavity 18 depends on the physical characteristics of excitable medium 20, as well as the characteristics of wall 30, and the contents of pumping cavity 16 and its effective bulk modulus. In effect, the net mechanical load on which excitation source acts is the combined load of the excitable medium 20, and pumped fluid 46, acting through wall 30. The speed of an acoustic wave in medium 20, is in turn a function of this mechanical load. For particular chosen combinations of excitation medium, and pumped fluid this net load, and net acoustic velocity is quite predictable.

For greater flexibility, optional sensor 38 may provide a control signal to ensure that driving cavity 18 is driven at an appropriate frequency, so that a standing wave is produced within driving cavity 18. Conveniently, this sensor may be placed along an axial position along the length of cavity 18, corresponding to the location of a node (as illustrated) or anti-node within the cavity 18. The optional controller may thus adjust the frequency of the excitation source 22 to ensure nodes (or anti-nodes) at the location of sensor 38. This, in turn, ensures that driving cavity 18 is resonant. Oscillations within driving cavity 18 may thus be tuned in a manner analogous to the tuning of a laser tube.

Figure 4:
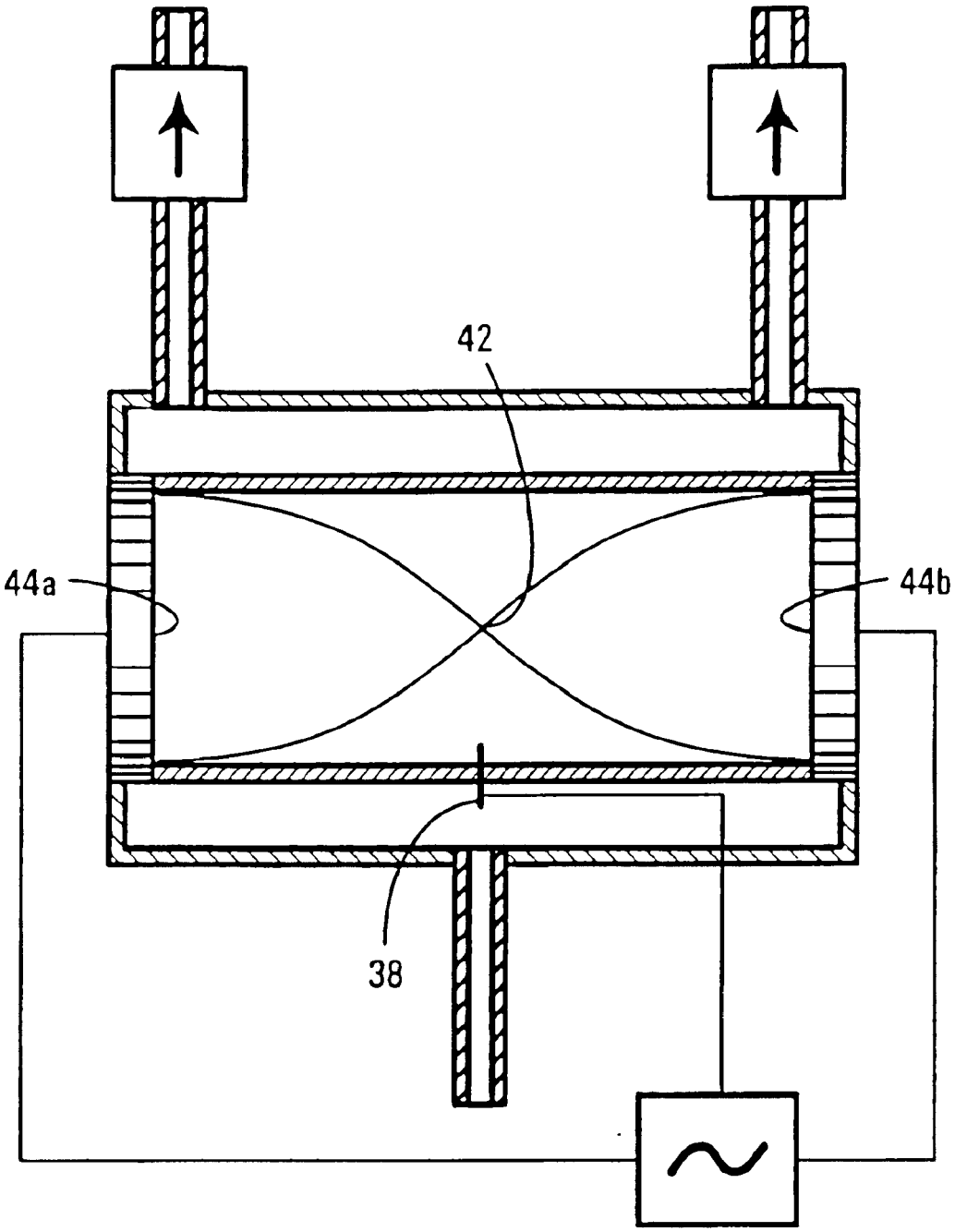
FIG. 4 is a schematic diagram illustrating mechanical displacement and pressure waves within the pump of FIG. 1, in operation.

As shown in FIG. 4 the standing pressure wave 40 so produced in the excitable medium 20 has pressure anti-nodes 44*a*, and 44*b* laterally proximate transducers 34*a* and 34*b* of housing 12 and a pressure node 42*a* midway along the length of housing 12. The instantaneous pressure at pressure anti-nodes 44*a* and 44*b* fluctuates above and below the undisturbed pressure (i.e. pre-pressurized static pressure) of excitable medium 20 while the instantaneous pressure at pressure nodes 42*a* remains relatively constant at the undisturbed pressure of the excitable medium 20. Thus, a fluctuating pressure differential is created between pressure node 42 and pressure anti-nodes 44. In particular, the pressure fluctuations at pressure anti-nodes 44*a* and 44*b* are of opposite phase.

Figure 5A:
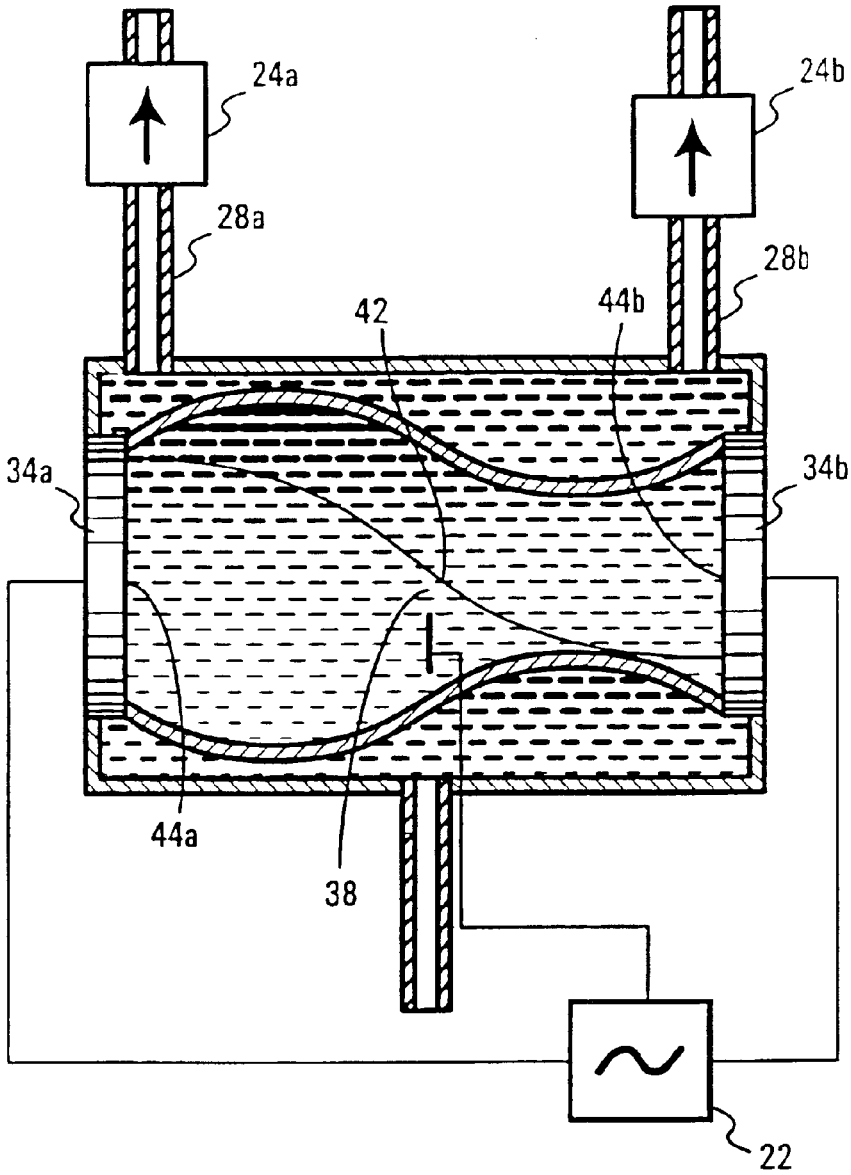
FIGS. 5A–5B schematically illustrate the pump of FIG. 1, in operation.
Figure 5A:
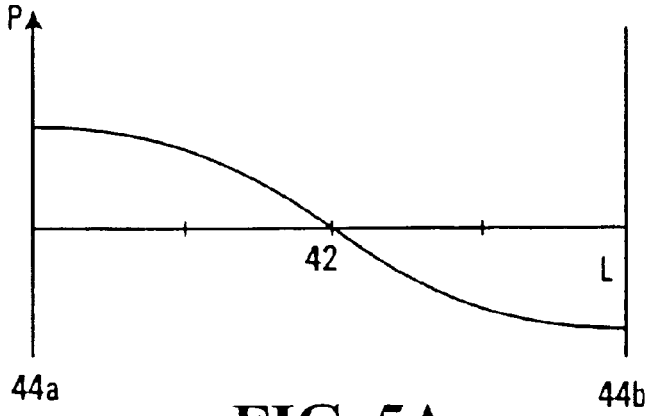
Figure 5B:
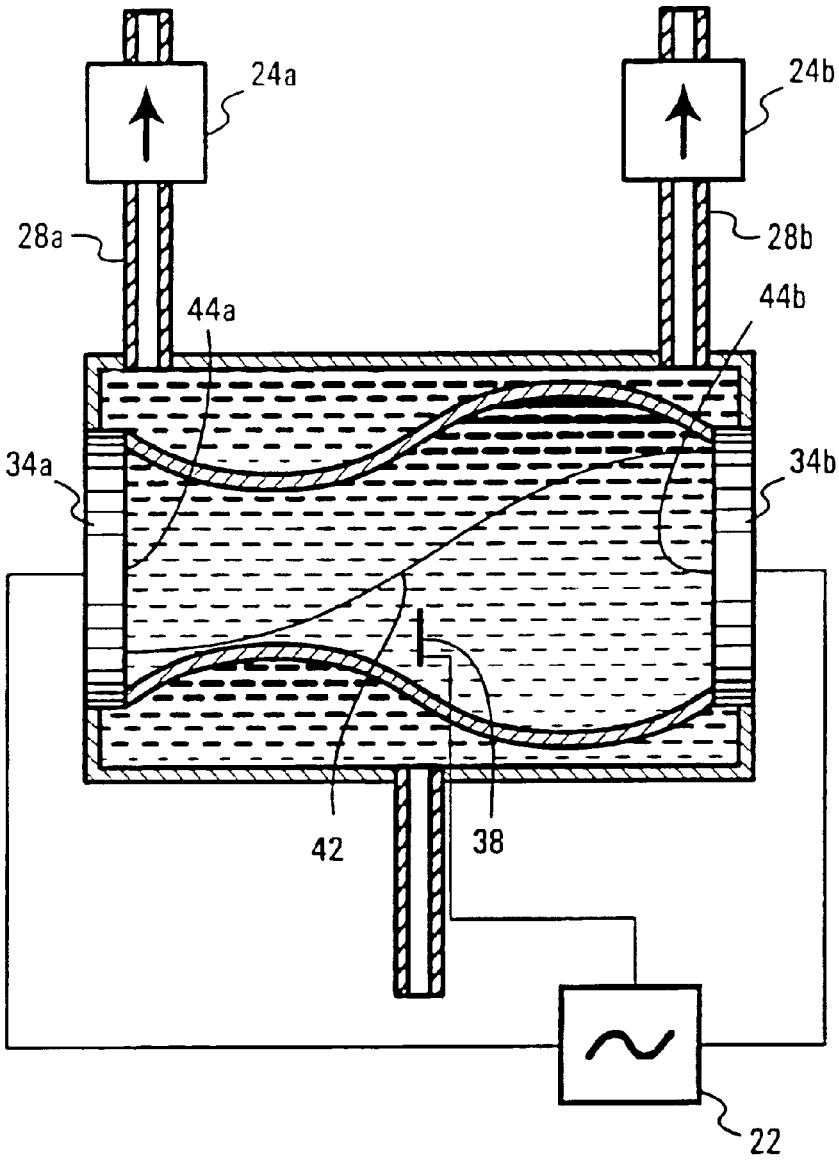
Figure 5B:
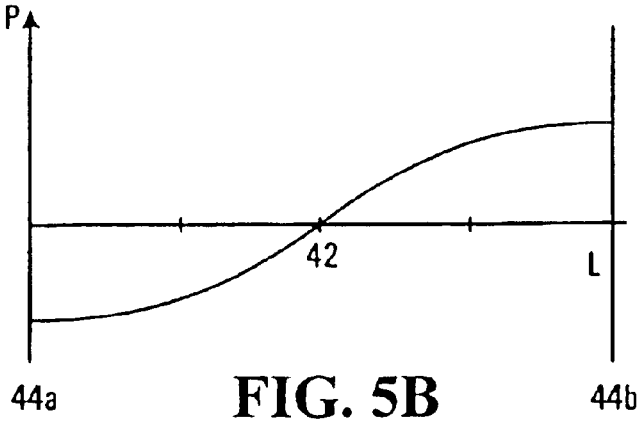

Now, since pressure within excitable medium 20 acts in all direction, outer wall 30 expands or contracts radially in accordance with fluctuations in the pressure wave 40. This is illustrated more particularly in FIGS. 5A and 5B. Specifically, FIG. 5A illustrates pump 10, in operation at a time t0. As illustrated, at this time t0, the amplitude of the standing pressure wave 40 is at its maximum at anti-node 44*a*, proximate transducer 34*a*. FIG. 5B illustrates pump 10 at a time t1 one half-period (or 1/(2*f*)) later. At this time t1, the amplitude of the standing pressure wave 40 is at its minimum at anti-node 44*a*. As noted, pressure within driving cavity 18 exerts a force on outer wall 30. This, in turn causes localized expansion and contraction of the outer wall 30 along its length, in a direction transverse to the direction of travel of the pressure waves within excitable medium 20. This is again illustrated in FIGS. 5A and 5B. The expansion and contraction illustrated in FIGS. 5A and 5B are exaggerated for purposes of illustration. As illustrated, as one half of housing 12 expands, its opposite half contracts, while the mid-point, proximate pressure node 42*a* does not expand or contract. This occurs at the resonant frequency of the system coupled to the excitation source.

Expanding and contracting outer wall 30, in turn, exerts a radial outward force and pressure on pumped fluid 46 within pumping cavity 16. The outer wall 30 obeys Hooke's law. However, pumped fluid within pumping cavity 16 acts on outer wall. As will be appreciated, pressure fluctuations within pumping cavity 16 are governed by the expansion and contraction of outer wall 30 and the distance between outer wall 30 and outer wall 32. As should now be appreciated, and as noted above, the resonant frequency within pumping cavity 16 will depend on the excitable medium 20, the stiffness of wall 30, and the effect of the fluid within pumping cavity 16 on this wall. That is, the resonant frequency within cavity 16 depends on the compound impedance of the net mechanical system being excited. Conveniently, however, excitation source 22 only acts directly on excitation medium 20.

As noted, sensor 38 in communication with controller of source 22 may allow the excitation source 22 to excite excitation medium 20 within cavity 18 to resonance for a wide variety of pumped fluids.

As should now be apparent, pressure sensor 38 could be replaced with a displacement sensor in the form of a strain gauge or the like, and located on the surface body 30 proximate a node. Resonance within cavity 18 could be controlled by using signals from sensor 38.

Now, pumped fluid 46 is guided into pumping cavity 16 by way of inlet 26. The resulting pressure gradient within pumped fluid 46 in cavity 16 along its length is also illustrated in FIGS. 5A and 5B. As illustrated, pressure within pumped fluid 46 varies least proximate node 42 and most significantly near anti-nodes 44*a* and 44*b*. Conveniently, inlet 26 and outlets 28 are located in lateral proximity to these pressure nodes 42 and anti-nodes 44, respectively. As such, as shown in the example embodiment of FIG. 1, inlet 26 may be laterally located midway between the transducers 34 of housing 12 proximate the pressure node 42*a*. Outlets 28 may be proximate the ends of wall 30 and proximate pressure anti-nodes 44*a* and 44*b*. Additionally one way check valves 24*a* and 24*b* ensure that pumped fluid 46 forced from pumping cavity 16 does not re-enter pumping cavity 16 as the pressure proximate an associated outlet 28 diminishes. Conveniently, sensor 38 may be located laterally proximate node 42*a* and inlet 26.

Notably, in the illustrated embodiment, the deflection maxima of cavity 18, near transducers 34*a* and 34*b* is limited by the radial restraint exerted by the boundary conditions the at the ends of housing 12 (i.e. where wall 30 meets transducers 34). As will be appreciated the pressure fluctuations within driving cavity 18 create a pressure gradient mirroring the standing wave pressure within driving cavity 18 within cavity 16.

Figure 4B:
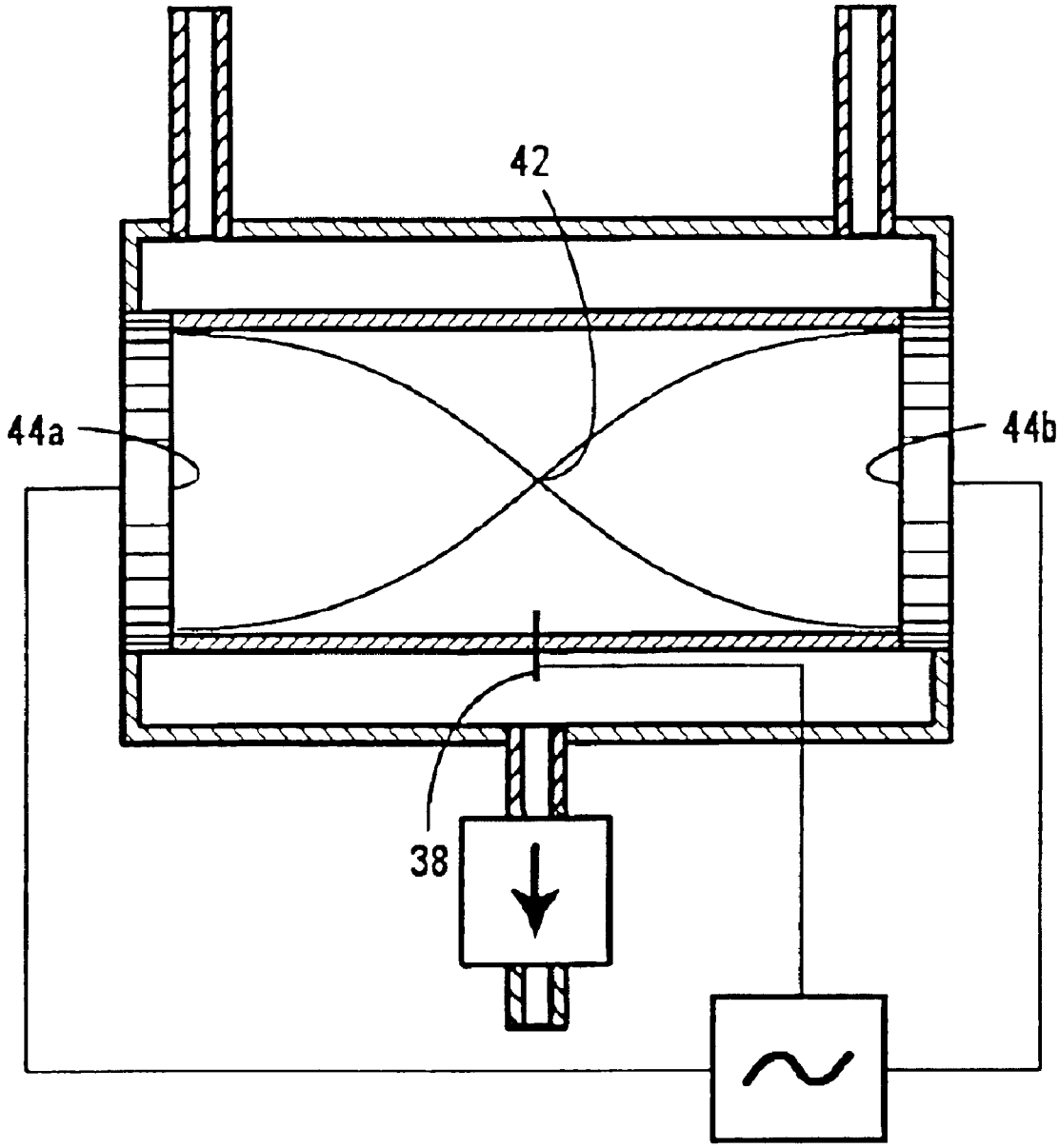
FIG. 4*b* is a similar schematic diagram of an alternate embodiment of the pump of FIG. 1.

As indicated above, since the pressure in driving cavity 18 at the pressure anti-nodes 44*a* and 44*b* oscillate above and below the undisturbed pressure of the excitable medium 20, similar pressure fluctuations occur in pumping cavity 16 due to the deformation of outer wall 30 and the rigidity of the outer wall 32. Since the pressure fluctuations are of opposite phase at each of the pressure anti-nodes 44*a* and 44*b* of pumping cavity 16 (i.e. proximate each of the outlets 28), the outlets 28*a* and 28*b* provide a differential output pumping flow: one outlet 28*a* pumps while the other outlet 28*b* does not and vice versa. Conveniently, outputs of valves 24*a* and 24*b*, downstream of outlets 28*a* and 28*b* may be joined to provide moderately constant steady state flow from pump 10. Alternatively, inlet and outlet valves 24 and 28 and could be laterally co-located along the length of pumping cavity 16. In this way, pump 10 could optionally be divided into two pumping chambers, one at each end. The two chambers could be isolated by a suitable membrane. Referring to FIG. 4*b*, in an alternate embodiment, the inlet(s) could be located also be at an anti-node, and the outlet(s) could be located at a node.

Generally, pressure fluctuations within both driving cavity 18 and within pumping cavity 16 are symmetrical about the undisturbed pressure of excitable medium 20 and pumped fluid 46, respectively. As the pressure within cavity 18 and pumping cavity 16 remains positive, pressure fluctuations may have peak values-to-peak values of two times the undisturbed pressure in each of cavity 16 and 18. However, as described below, a number of pump stages may be combined to obtain as large a pressure ratio as is desired.

As should now be appreciated, excitable medium 20 may be excited anywhere along its length (other than at a node) in order to establish a suitable travelling wave, and thus establish a standing pressure wave, as illustrated. Conveniently, the location of any excitation source 22 that excites excitable medium 20 will affect the magnitude of the pressure differential between nodes and anti-nodes. That is, the pressure differential can be adjusted, by locating excitation source 22 input at a location towards the midpoint of housing 12. The nearer the excitation source 22 acts to a node, the less the excitation source need vary the pressure of the excitable medium 20, while still establishing a standing wave, as illustrated. A pressure amplification of the alternating pressure of excitation source 20 (within the driving cavity 18) can be obtained, thus allowing for proper matching between the driving cavity 18 operating pressure and the available alternating pressure value.

As should now also be appreciated, annular wall 36 need not be annular, or co-planar with transducer 34. Pumping cavity 16 could be sealed with rigid end-walls separate from or forming part of, end walls (not shown) sealing driving cavity 18. In this case, excitation source 22 could be located within driving cavity 18 and could use rigid end walls (not shown) to establish a standing wave. Moreover, excitation source 22 need not generate the standing wave pattern depicted in FIGS. 4, 5A and 5B. Many suitable variations of standing wave patterns, including an arbitrary number of nodes and anti-nodes may be similarly used in order to pump liquid in a pump similar to pump 10. Pressure nodes need not be formed at the ends of housing 12. Instead, end walls of housing 12 could be rigid and pressure anti-nodes may be formed at these end walls. Similarly, driving cavity 18 and arrangement of excitation source 22 need not generate a standing wave that is symmetric about the length of driving cavity 18. Instead, a single transducer or other agitator may be located within driving cavity 18. Of course, inlets and outlets may need to be appropriately located proximate pressure nodes and anti-nodes in such alternate standing wave patterns. As well, housing 12 need not be entirely contained within outer body 14. Instead, only a portion of outer wall 32 need extend within a pumping cavity formed between outer wall 32 of outer body 14 and outer wall 30 of housing 12.

Advantageously, excitation source 22 does not act directly on pumped fluid 46 allowing pump 10 to pump a larger variety of pumped media. Further, excitable medium 20 and excitation source 22 can be freely chosen to provide an efficient pumping action without regard to the pumped fluid 46. For example, when excitation source 22 includes an electrical discharge device, the excitable medium 20 must support the electrical discharge phenomenon and preferably, in a way that does not deteriorate the excitable medium 20 significantly. In this case, examples of excitable media include water, fuel, oil, or the like.

Figure 6:
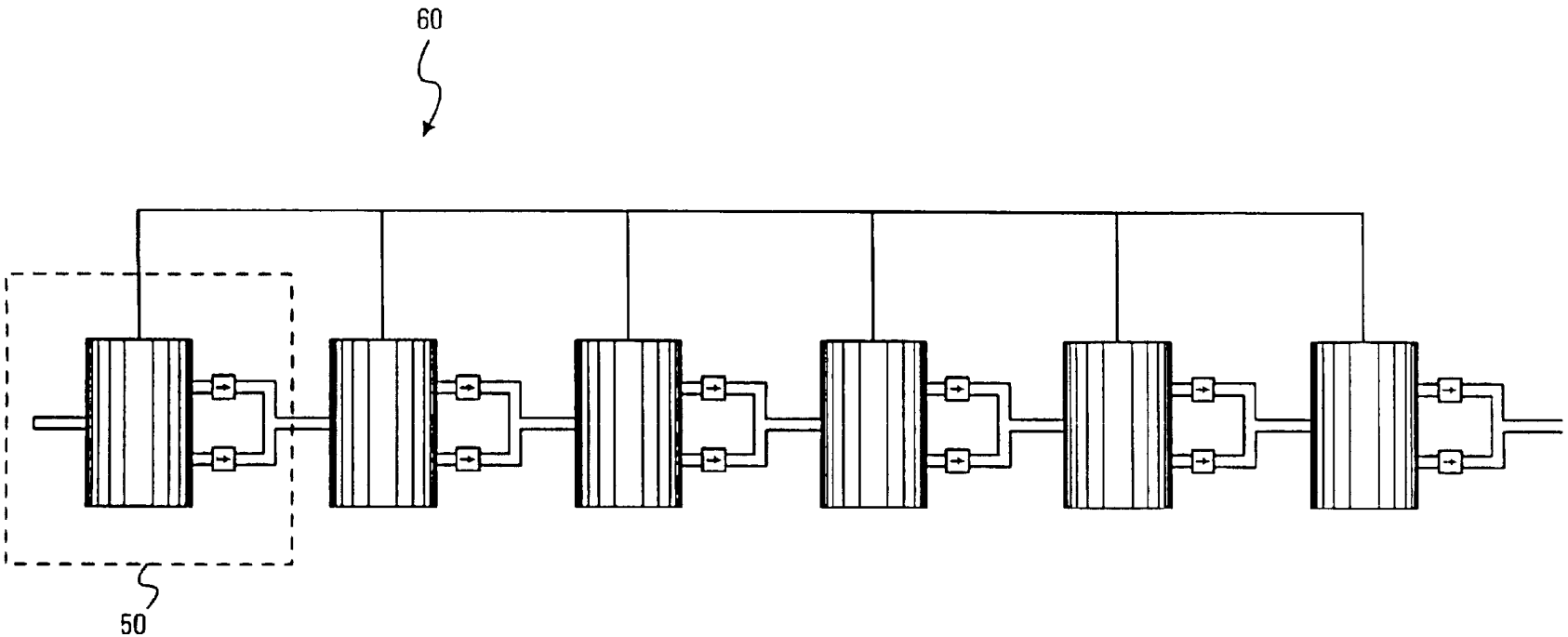
FIG. 6 is a schematic diagram of a multi-stage pump arrangement using the pump assembly of FIG. 1.

FIG. 6 schematically illustrates a multi-stage pump 60 that uses a plurality of single-stage pumps 50 each identical to exemplary pump 10 of FIG. 1. The plurality of single stage pumps 50 are arranged in series so that the pressurized output of one single stage pump 50 is fed to the input of an adjacent downstream pump 50 in order to further pressurize fluid pressurized by a previous single stage pump 50. Excitation sources (identical to source 22 of FIG. 1) for each single stage pump 50 are not shown in FIG. 6. In the multi-stage pump 60, these excitation sources may preferably be coupled to operate in phase. Alternatively, a single common excitation source (not shown) may be used to drive each of the single stage pumps 50. As with pump 10, the total flow rate of the multi-stage pump 60 is controlled by the magnitude and frequency of the excitation source. Advantageously, each of the multi-stage pumps partially pressurized the pumped liquid. The pumping cavity of each of the single-stage pump 50 need only be pre-pressurized to the contribution of that stage. Conveniently, multi-stage pump 60 could be constructed using micro-machining techniques to provide an integrated multistaged pump 60 in a single compact package, in a manner readily understood by those of ordinary skill. One possible use of such a multi-stage pump 60 may be in, and as an integral part of, a fuel nozzle (not shown) of an engine (not shown).

A pump 10 or multi-stage pump 60 as described in the embodiments above is intended for use in fuel delivery, possibly as individual fuel nozzles or pumps and may also be usable for fuel and oil pressurization. Pump 10 can be usable with virtually any fluid such as oils, refrigerants, fuels etc. The pump may also be useful for underwater propulsion devices and possibly also for gas pumping or compressing applications.

As should be appreciated pump 10 or multi-stage pump 60 as described in the embodiments above could be effective for pumping virtually any fluid, even fluids containing suspended solids of relatively large sizes, since there are few moving parts to come into contact with the suspended solids and result in mechanical failure and also since there is no need to directly excite the pumped fluid.

It will be further understood that the invention is not limited to the embodiments described herein which are merely illustrative of preferred embodiments of carrying out the invention, and which are susceptible to modification of form, arrangement of parts, steps, details and order of operation. The invention, rather, is intended to encompass all such modification within its scope, as defined by the claims.

What is claimed is:

1. A method of pumping a pumped fluid comprising:

exciting an excitable medium provided in a housing to produce a standing wave therein and thereby produce deformations in said housing;

providing said pumped fluid to a pumping cavity in communication with said housing such that said deformation generates volume changes in said pumping cavity; and whereby said pumped fluid is pumped through said pumping cavity.

2. A method of pumping a pumped fluid comprising:

establishing a standing wave within a secondary fluid;

allowing said secondary fluid to exert pressure on a wall in contact with said pumped fluid, to deform said wall;

using deformation of said wall to pump said pumped fluid from an inlet to an outlet, laterally spaced from each other along a length of said wall.

* * * * *